US007510761B2

(12) United States Patent
Kondo et al.

(10) Patent No.: US 7,510,761 B2
(45) Date of Patent: Mar. 31, 2009

(54) CUTTING TOOL MADE OF SURFACE-COATED CEMENTED CARBIDE WITH HARD COATING LAYER EXHIBITING EXCELLENT WEAR RESISTANCE IN HIGH SPEED CUTTING OPERATION OF HIGH HARDNESS STEEL

(75) Inventors: Akihiro Kondo, Yuuki-gun (JP); Yusuke Tanaka, Yuuki-gun (JP); Koichi Maeda, Akashi (JP)

(73) Assignee: Mitsubishi Materials Corporation, Tokyo (JP)

( * ) Notice: Subject to any disclaimer, the term of this patent is extended or adjusted under 35 U.S.C. 154(b) by 393 days.

(21) Appl. No.: 11/352,111

(22) Filed: Feb. 9, 2006

(65) Prior Publication Data

US 2006/0183000 A1 Aug. 17, 2006

(30) Foreign Application Priority Data

Feb. 14, 2005 (JP) ..... 2005-035684

(51) Int. Cl.
*B23B 27/14* (2006.01)

(52) U.S. Cl. ..... 428/216; 51/307; 51/309; 428/336; 428/446; 428/697; 428/698; 428/699

(58) Field of Classification Search ..... 51/307, 51/309; 428/216, 336, 446, 697, 698, 699
See application file for complete search history.

(56) References Cited

U.S. PATENT DOCUMENTS

| | | | | |
|---|---|---|---|---|
| 5,580,653 | A | 12/1996 | Tanaka et al. | |
| 6,586,122 | B2 * | 7/2003 | Ishikawa et al. | 428/698 |
| 7,060,345 | B2 * | 6/2006 | Fukui et al. | 428/216 |
| 7,150,925 | B2 | 12/2006 | Sato et al. | |
| 2004/0157090 | A1 | 8/2004 | Yamamoto et al. | |

FOREIGN PATENT DOCUMENTS

| | | |
|---|---|---|
| CN | 1578710 A | 2/2005 |
| EP | 1174528 | 1/2002 |
| EP | 1382709 | 1/2004 |
| JP | 2793773 B2 | 9/1998 |
| JP | 2000-297364 | 10/2000 |

OTHER PUBLICATIONS

European Search Report dated Feb. 22, 2007 issued for corresponding European Patent Application No. 06101457.

* cited by examiner

*Primary Examiner*—Archene Turner
(74) *Attorney, Agent, or Firm*—Darby & Darby P.C.

(57) ABSTRACT

A cutting tool made of surface-coated cemented carbide having the hard coating layer formed on the surface of a cemented carbide substrate, wherein the hard coating layer has a top layer and a bottom layer, the top layer includes a structure having the thin layer A and the thin layer B being stacked alternately, with the thin layer A having the composition of $[Ti_{1-(A+B)}Al_ASi_B]N$ (A is in a range from 0.01 to 0.06 and B is in a range from 0.25 to 0.35 in an atomic ratio) and the thin layer B having the composition of $[Ti_{1-(C+D)}Al_CSi_D]N$ (C is in a range from 0.30 to 0.45 and D is in a range from 0.10 to 0.15), and the bottom layer comprises single phase structure having the composition of $[Ti_{1-(E+F)}Al_ESi_F]N$ (E is in a range from 0.50 to 0.60 and F is in a range from 0.01 to 0.09).

1 Claim, 2 Drawing Sheets

CUTTING TOOL MADE OF SURFACE-COATED CEMENTED CARBIDE WITH HARD COATING LAYER EXHIBITING EXCELLENT WEAR RESISTANCE IN HIGH SPEED CUTTING OPERATION OF HIGH HARDNESS STEEL

BACKGROUND OF THE INVENTION

1. Field of the Invention

The present invention relates to a cutting tool made of surface-coated cemented carbide (hereinafter referred to as a surface-coated cemented carbide tool) provided with a hard coating layer that has excellent heat resistance, maintains high hardness and high strength at high temperatures and, as a consequence, exhibits excellent wear resistance even in high speed cutting operation of a high hardness steel, such as alloy tool steel or hardened bearing steel, which requires especially high heat resistance and generates much heat during the cutting operation.

Priority is claimed on Japanese Patent Application No. 2005-035684, filed Feb. 14, 2005, the content of which is incorporated therein by reference.

2. Description of Related Art

A surface-coated cemented carbide tool in general includes indexable insert that is removably attached at the tip of a cutting tool for machining of workpieces made of various steels or cast iron in turning or planning operation, drill bit or miniature drill bit that is used in drilling of workpieces and solid type end mill that is used for machining of workpieces in face milling, slot cutting (grooving) or stepping (shouldering) operation. The surface-coated cemented carbide tool also includes indexable end mill tool. The indexable insert of the indexable end mill tool is removably attached to an end mill and is used in cutting operation in a manner similar to that of the solid type end mill.

One known constitution of the surface-coated cemented carbide tool comprises a carbide substrate made of tungsten carbide-based cemented carbide (hereinafter abbreviated as WC) or titanium carbonitride-based cermet (hereinafter abbreviated as TiCN) of which surface is coated with a hard coating layer formed to a thickness of 0.1 to 20 μm by vapor deposition from a composite nitride of Ti, Al and Si (hereinafter referred to as (Ti, Al, Si)N) in single phase structure and composition of $[Ti_{1-(X+Y)}Al_XSi_Y]N$ (X is in a range from 0.05 to 0.75 and Y is in a range from 0.01 to 0.10 in an atomic ratio). It is known that the (Ti, Al, Si)N layer has the hardness at high temperatures improved by the Al content, the strength at high temperatures improved by the Ti content and the heat resistance improved by the Si content.

It is also known that the surface-coated cemented carbide tool described above can be manufactured by coating the surface of the carbide substrate with the hard coating layer consisting of the (Ti, Al, Si)N layer in the following process: with the carbide substrate set in an arc ion plating apparatus, that is a variation of physical vapor deposition apparatus schematically illustrated in FIG. 3, arc discharge is generated by supplying a current of 90 A, for example, between an anode and a cathode (evaporation source) having of a Ti—Al—Si alloy of a predetermined composition within the apparatus where the ambient temperature is maintained at, for example, 500° C. by means of a heater, while nitrogen gas is introduced as a reaction gas into the apparatus so as to create a reaction atmosphere with a pressure of 2 Pa, and a bias voltage of −100 V, for example, is applied to the carbide substrate.

Patent Reference 1: Specification of Japanese Patent No. 2,793,773

There have been dramatic advancements in the performance of metal cutting machines in recent years. On the other hand, there are still strong demands for labor saving, energy saving and cost reduction in metal cutting operations, resulting in a trend toward higher cutting speed. The surface-coated cemented carbide tool of the prior art, provided that it is made of a material having a composition properly selected for the cutting conditions, performs satisfactorily in machining of steels and cast iron under ordinary cutting conditions. However, when used in high speed cutting operation of a high hardness steel, such as alloy tool steel or hardened bearing steel which has Rockwell hardness (C scale) as high as 50 or more and generates much heat during cutting operation, the surface-coated cemented carbide tool of the prior art wears off very quickly due to the insufficient heat resistance of the hard coating layer, thus failing in a relatively short period of time.

The present invention has been made in consideration of the problems of the prior art described above, and aims at providing a surface-coated cemented carbide tool that has excellent wear resistance and longer service life, and allows for labor saving, energy saving and cost reduction in metal cutting operations.

SUMMARY OF THE INVENTION

The present inventors conducted a research focused on the (Ti, Al, Si)N layer that constitutes the hard coating layer of the surface-coated cemented carbide tool of the prior art, aiming at the development of a surface-coated cemented carbide tool having a hard coating layer that exhibits excellent wear resistance in high speed cutting operation of a high hardness steel, and arrived at findings (1) through (3) as follows.

(1) While heat resistance of the (Ti, Al, Si)N layer that constitutes the hard coating layer can be improved by increasing the proportion of Si content included therein, proportion of Si content about 1 to 10% by the number of atoms (atomic %) that is typical in the conventional (Ti, Al, Si)N cannot achieve a high heat resistance that is required for high speed cutting operation of a high hardness steel. Satisfying such a requirement makes it necessary to increase the proportion of Si content to a level from 25 to 35 atomic %, far higher than the conventional level of 1 to 10 atomic %. Meanwhile, practical use of the (Ti, Al, Si)N layer having Si content in a range from 25 to 35 atomic % requires it to include a predetermined proportion of Ti so as to ensure a required level of strength at high temperatures, which inevitably results in a significantly lower proportion of Al content that in turn leads to very low hardness at high temperatures.

(2) When a (Ti, Al, Si)N layer having the composition of $[Ti_{1-(A+B)}Al_ASi_B]N$ (A is in a range from 0.01 to 0.06 and B is in a range from 0.25 to 0.35 in an atomic ratio) including Si content in a range from 25 to 35 atomic % and a (Ti, Al, Si)N layer having the composition of $[Ti_{1-(C+D)}Al_CSi_D]N$ (C is in a range from 0.30 to 0.45 and D is in a range from 0.10 to 0.15 in an atomic ratio) including relatively higher Al content each having the thickness of 5 to 20 nm are stacked alternately one on another, the resultant stack combines excellent heat resistance of the (Ti, Al, Si)N layer that includes high Si content (hereinafter referred to as thin layer A) and relatively high hardness at high temperatures of the (Ti, Al, Si)N layer that includes Si content lower than that of the thin layer A and relatively high Al content (hereinafter referred to as thin layer B) exhibited due to the constitution of both thin layers stacked alternately.

(3) The (Ti, Al, Si)N layer having structure consisting of the thin layer A and the thin layer B stacked alternately as described in (2) above has excellent heat resistance and a predetermined level of hardness at high temperatures that are required for high speed cutting operation of high hardness steel, but does not have sufficiently high hardness at high temperatures, and therefore this (Ti, Al, Si)N layer is provided as the top layer of the hard coating layer. On the other hand, a structure constituted from the hard coating layer provided with a bottom layer consisting of a (Ti, Al, Si)N layer having the composition comparable to that of the conventional hard coating layer that has insufficient heat resistance but sufficiently high hardness at high temperatures due to relatively high Al content, namely (Ti, Al, Si)N layer of single phase structure having the composition of $[Ti_{1-(E+F)}Al_ESi_F]N$ (E is in a range from 0.50 to 0.60 and F is in a range from 0.01 to 0.09 in an atomic ratio) is provided as the bottom layer of the hard coating layer. As a result, the hard coating layer exhibits heat resistance, strength at high temperatures and hardness at high temperatures all of sufficiently high levels. Consequently, the surface-coated cemented carbide tool having the hard coating layer formed by vapor deposition exhibits excellent wear resistance over an extended period of time without generating chipping even in high speed cutting operation of the high hardness steel.

The findings (1) through (3) were obtained through the inventors' research.

The present invention has been made on the basis of the findings described above, and provides a cutting tool made of surface-coated cemented carbide, including a carbide substrate made of tungsten carbide-based cemented carbide or titanium carbonitride-based cermet provided with a hard coating layer formed on the surface of the carbide substrate by vapor deposition, with the hard coating layer having such a constitution as described below, thus providing the surface-coated cemented carbide cutting tool having the hard coating layer that exhibits excellent heat resistance in high speed cutting operation of high hardness steels.

(a) The hard coating layer includes a top layer and a bottom layer both formed from (Ti, Al, Si)N, the top layer having the thickness of 0.5 to 1.5 μm and the bottom layer having the thickness of 2 to 6 μm.

(b) The top layer includes a structure having the thin layer A and the thin layer B stacked alternately each having the thickness of 5 to 20 nm, with the thin layer A including (Ti, Al, Si)N having the composition of $[Ti_{1-(A+B)}Al_ASi_B]N$ (A is in a range from 0.01 to 0.06 and B is in a range from 0.25 to 0.35 in an atomic ratio) and the thin layer B including (Ti, Al, Si)N having the composition of $[Ti_{1-(C+D)}Al_CSi_D]N$ (C is in a range from 0.30 to 0.45 and D is in a range from 0.10 to 0.15 in an atomic ratio)

(c) The bottom layer includes (Ti, Al, Si)N layer of single phase structure having the composition of $[Ti_{1-(E+F)}Al_ESi_F]N$ (E is in a range from 0.50 to 0.60 and F is in a range from 0.01 to 0.09 in an atomic ratio).

Now the reasons for setting the numerical specifications for the hard coating layer of the surface-coated cemented carbide tool of the present invention will be described below.

(1) Composition and Thickness of the Bottom Layer

Al content of the (Ti, Al, Si)N layer that constitutes the hard coating layer has an effect of improving hardness at high temperatures, Ti content of the (Ti, Al, Si)N layer has an effect of improving strength at high temperatures and Si content of the (Ti, Al, Si)N layer has an effect of improving heat resistance. While Al content in the bottom layer is made relatively high so as to have high hardness at high temperatures, when the value of E that represents the proportion of Al content is less than 0.50 (proportion of the number of atoms, the same applies throughout the following description) in proportion to the sum of Ti and Si, the Ti content becomes relatively higher and high hardness at high temperatures required in high speed cutting operation of high hardness steel cannot be achieved, thus resulting in rapid progress of wear. When the value of E that represents the proportion of Al content is higher than 0.60 in proportion to the sum of Ti and Si, the Ti content becomes too low and strength at high temperatures rapidly decreases, thus making the trouble of chipping more likely to occur. Accordingly, the value of E was set in a range from 0.50 to 0.60.

When the value of F that represents the proportion of Si content is less than 0.01 in proportion to the sum of Ti and Al, required level of heat resistance cannot be achieved. When the value of F that represents the proportion of Si content is more than 0.09 in proportion to the sum of Ti and Al, it becomes difficult to achieve the required level of strength at high temperatures. Accordingly, the value of F was set in a range from 0.01 to 0.09.

When the layer thickness is less than 2 μm, the hard coating layer cannot maintain the excellent hardness at high temperatures over a long period of time, thus resulting in a shorter service life. When the layer thickness is more than 6 μm, chipping is more likely to occur. Accordingly, the layer thickness is set in a range from 2 to 6 μm.

(2) Composition of Thin Layer A of Top Layer

Si component in (Ti, Al, Si)N of the thin layer A of the top layer is included relatively higher for the purpose of improving the heat resistance so as to provide for high speed cutting operation of high hardness steel that generates much heat. Consequently, when the value of B is less than 0.25, required level of heat resistance cannot be achieved. When the value of B is more than 0.35, a decrease in strength of the top layer at high temperatures cannot be avoided even when the thin layer B of excellent strength at high temperatures is provided adjacent to the thin layer A, thus making it easier for chipping to occur. Accordingly, the value of B is set in a range from 0.25 to 0.35.

When the value of A that represents the proportion of Al content is less than 0.01 in proportion to the sum of Ti and Al, the minimum required level of hardness at high temperatures cannot be achieved and wear may be accelerated. When the value of A that represents the proportion of Al content is more than 0.06 in proportion to the sum of Ti and Al, strength at high temperatures tends to decrease, thus making it easier for chipping to occur. Accordingly, the value of A is set in a range from 0.01 to 0.06.

(3) Composition of Thin Layer B of Top Layer

Si content in the thin layer B of the top layer is made relatively lower and Al content is made relatively higher, so that the thin layer B has relatively higher hardness at high temperatures to compensate for the low hardness of the adjoining thin layer A at high temperatures, thereby to form the top layer that combines the excellent heat resistance of the thin layer A and the required level of hardness of the thin layer B at high temperatures. When the value of C that represents the proportion of Al content in the composition of the thin layer B is less than 0.30, Al content is too low to maintain the required level of hardness at high temperatures and wear of the hard coating layer may be accelerated. When the value of C that represents the proportion of Al content in the composition of the thin layer B is more than 0.45, the resulting relatively low Ti content inevitably leads to a decrease in strength at high temperatures, thus making it easier for chipping to occur. Accordingly, the value of C is set in a range from 0.30 to 0.45.

When the value of D that represents the proportion of Si content in proportion to the sum of Ti and Al is less than 0.10, it inevitably leads to a decrease in the heat resistance of the top layer as a whole. When the value of D that represents the proportion of Si content is more than 0.15, strength of the top layer as a whole at high temperatures decreases. Accordingly, the value of D is set in a range from 0.10 to 0.15.

(4) Thickness of the Thin Layer A and the Thin Layer B of Top Layer

When each of the thin layer A and the thin layer B of the top layer is less than 5 nm in thickness, it is difficult to form the thin layers precisely with the compositions described above, thus making it impossible to ensure the required levels of heat resistance and of hardness of the top layer at high temperatures. When each of the thin layer A and the thin layer B of the top layer is more than 20 nm in thickness, drawback of each thin layer, namely insufficient hardness of the thin layer A at high temperatures or insufficient heat resistance of the thin layer B, appears locally in the layer, thus making it easier for chipping to occur or accelerating the progress of wear. Accordingly, the thickness of each layer was set in the range from 5 to 20 nm (5) Thickness of Top Layer When the top layer is less than 0.5 μm in thickness, excellent heat resistance thereof cannot be rendered on the hard coating layer over an extended period of time, thus resulting in a shorter service life of the cutting tool. When the top layer is more than 1.5 μm in thickness, chipping is likely to occur. Accordingly, the thickness of the layer was set in the range from 0.5 to 1.5 μm.

The surface-coated cemented carbide tool of the present invention is provided with the hard coating layer having the (Ti, Al, Si)N layer. By forming the hard coating layer having the top layer and the bottom layer of single phase structure and forming the top layer in a structure having the thin layer A and the thin layer B stacked alternately one on another, it is made possible to achieve excellent heat resistance and make use of the high hardness of the bottom layer of single phase structure at high temperatures, so that excellent wear resistance can be maintained over an extended period of time without undergoing chipping of the hard coating layer even in high speed cutting operation of a high hardness steel that generates much heat during cutting operation.

DETAILED DESCRIPTION OF THE INVENTION

Figure 1:
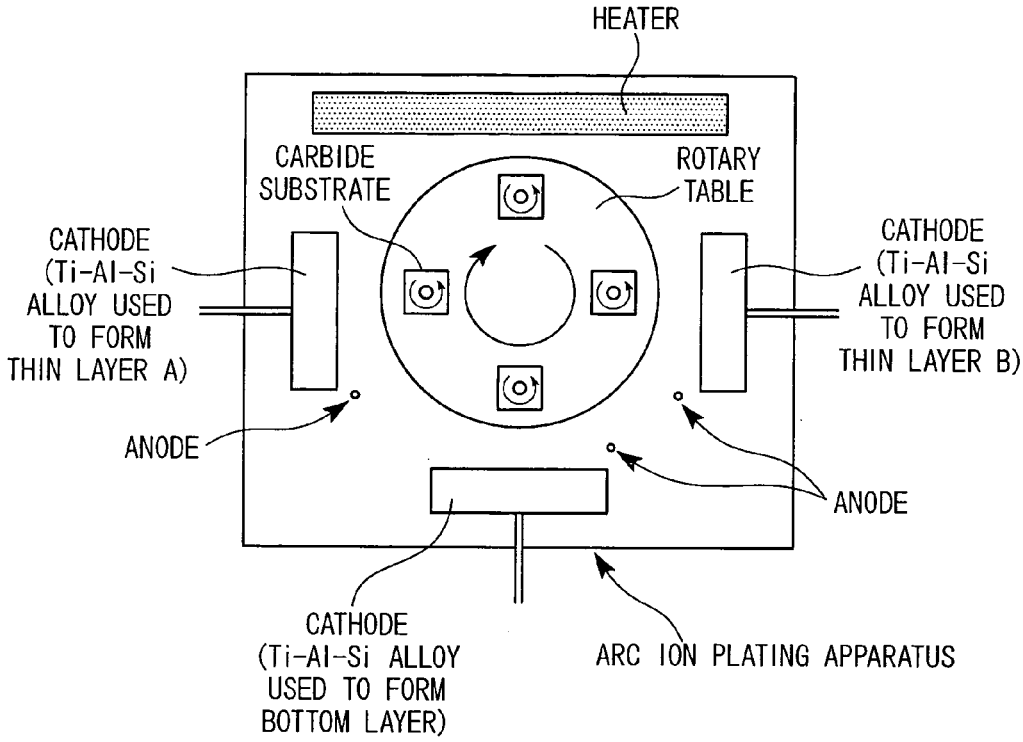
FIG. 1 is a schematic plan view of an arc ion plating apparatus used to form the hard coating layer that constitutes the surface-coated cemented carbide tool of the present invention.

The surface-coated cemented carbide tool of the present invention will now be described in detail below by way of examples.

EXAMPLE 1

A WC powder, a TiC powder, a ZrC powder, a VC powder, a TaC powder, a NbC powder, a $Cr_3C_2$ powder, a TiN powder, a TaN powder and a Co powder, all having a mean particle size in a range from 1 to 3 μm, were prepared as material powders, and were mixed in proportions shown in Table 1, by means of a ball mill in wet process for 72 hours. After drying, the mixture was pressed into a green compact with a pressure of 100 MPa. The green compact was sintered by heating at a temperature of 1400° C. for 1 hour in vacuum of 6 Pa. The sintered material was subjected to honing process to form a cutting edge with a curvature of R 0.03, thereby making carbide substrates A-1 through A-10 made of WC-based cemented carbide having the tip configuration of CNMG120408 specified in ISO standard.

A TiCN powder (TiC/TiN=50/50 in weight proportion), a $Mo_2C$ powder, a ZrC powder, a NbC powder, a TaC powder, a WC powder, a Co powder and a Ni powder, all having a mean particle size in a range from 0.5 to 2 μm, were prepared as material powders, and were mixed in proportions shown in Table 2, by means of a ball mill in wet process for 24 hours. After drying, the mixture was pressed into green compacts with a pressure of 100 MPa. The green compacts were sintered by heating at a temperature of 1500° C. for 1 hour in nitrogen atmosphere of 2 kPa. The sintered material was subjected to honing process to form a cutting edge with a curvature of R 0.03, thereby making carbide substrates B-1 through B-6 made of TiCN-based cermet having the tip configuration of CNMG120408 specified in ISO standard.

Figure 2:
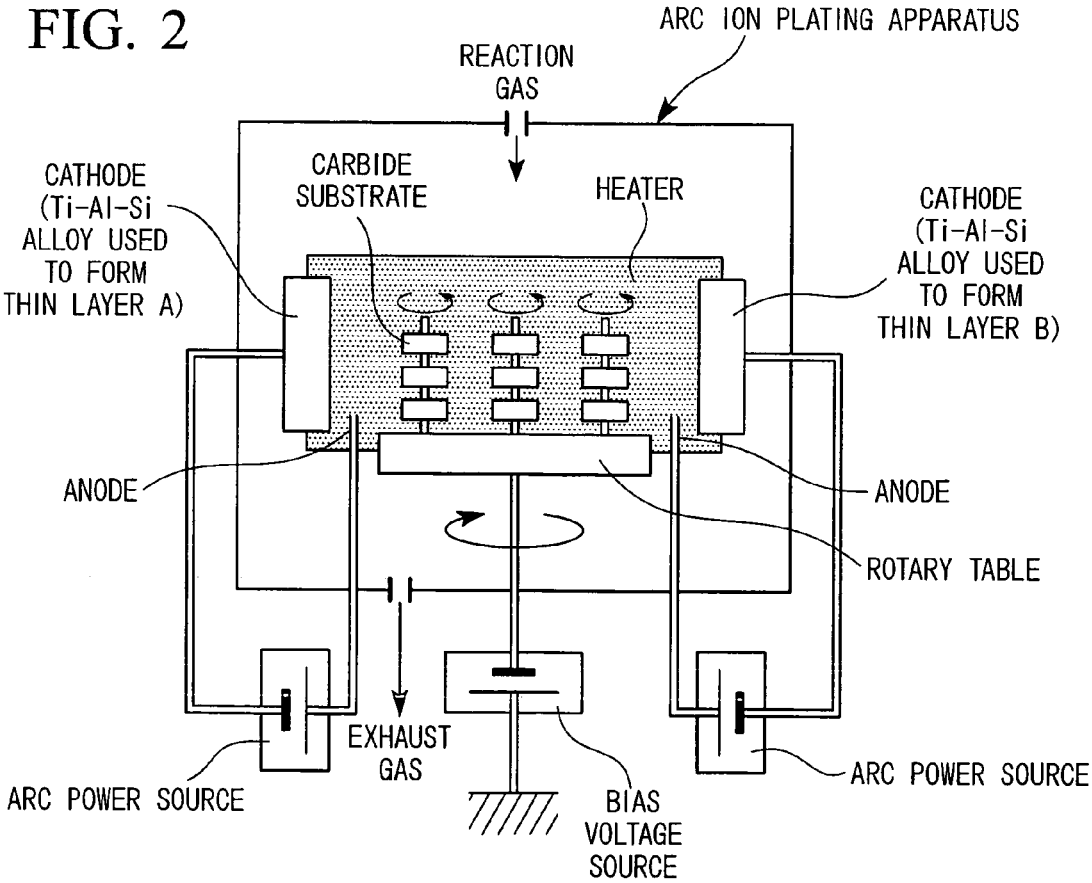
FIG. 2 is a schematic front view of the arc ion plating apparatus used to form the hard coating layer that constitutes the surface-coated cemented carbide tool of the present invention.

(1) Then the carbide substrates A-1 through A-10 and the carbide substrates B-1 through B-6 were subjected to ultrasonic cleaning in acetone. After drying, the carbide substrates were mounted on a rotary table along the circumference thereof at a predetermined distance from the center in the radial direction, in an arc ion plating apparatus as shown in FIG. 1 and FIG. 2. A Ti—Al—Si alloy for forming the thin layer A of the top layer having the composition corresponding to the target composition shown in Tables 3, 4 was disposed as a cathode (evaporation source) on one side, and a Ti—Al—Si alloy for forming the thin layer B of the top layer having the composition corresponding to the target composition shown in Tables 3, 4 was disposed as a cathode (evaporation source) on the other side opposing each other with the rotary table located therebetween. A Ti—Al—Si alloy for forming the bottom layer was disposed as a cathode (evaporation source) at a position at 90 degrees from the two Ti—Al—Si alloy sources along the table.

(2) While evacuating the apparatus to maintain the inside at a level of vacuum not higher than 0.1 Pa, the inside of the apparatus was heated to 500° C. by a heater and a DC bias voltage of −1000 V was applied to the carbide substrate that was spinning on the rotating table. At the same time, arc discharge was generated by supplying a current of 100 A between the Ti—Al—Si alloy used for forming the bottom layer and the anode, thereby cleaning the surface of the carbide substrate by bombardment of the Ti—Al—Si alloy.

(3) Then nitrogen gas was introduced as a reaction gas into the apparatus to maintain a reaction atmosphere of 3 Pa, and a DC bias voltage of −100 V was applied to the carbide substrate that was spinning on the rotating table. At the same time, arc discharge was generated by supplying a current of 100 A between the Ti—Al—Si alloy used for forming the bottom layer and the anode, thereby to coat the surface of the carbide substrate with the (Ti, Al, Si)N layer having single phase structure of the target composition shown in Tables 3, 4 and the target layer thickness, formed as the bottom layer of the hard coating layer by vapor deposition.

(4) Then nitrogen gas was introduced as a reaction gas into the apparatus to maintain a reaction atmosphere of 2 Pa, and a DC bias voltage of −100 V was applied to the carbide substrate that was spinning on the rotating table. At the same time, arc discharge was generated by supplying a current of predetermined intensity in a range from 50 to 200 A between the Ti—Al—Si alloy used for forming the thin layer A and the anode, thereby to form the thin layer A of a predetermined thickness on the surface of the carbide substrate. After forming the thin layer A, the arc discharge was stopped and a current of predetermined intensity in a range from 50 to 200 A was supplied between the cathode of Ti—Al—Si alloy used for forming the thin layer B and the anode, thereby to generate discharge arc and form the thin layer B of the predetermined thickness. Then the arc discharge was stopped (in this case, the process may be started with the formation of the thin layer B). Then again the formation of the thin layer A by means of arc discharge between the cathode of a Ti—Al—Si alloy used for forming the thin layer A and the anode, and the formation of the thin layer B by means of arc discharge between the cathode of a Ti—Al—Si alloy used for forming the thin layer B and the anode were repeated alternately. Thus the top layer including the structure having the thin layer A and the thin layer B stacked alternately having the target composition and the target thickness for single layer shown in Tables 3, 4 was formed along the direction of the layer thickness on the surface of the carbide substrate with the target total thickness shown in Tables 3, 4 by vapor deposition. Thus indexable inserts made of the surface-coated cemented carbide of the present invention (hereinafter referred to as the inventive surface-coated cemented carbide insert) Nos. 1 through 16 were made as the surface-coated cemented carbide cutting tool of the present invention.

Figure 3:
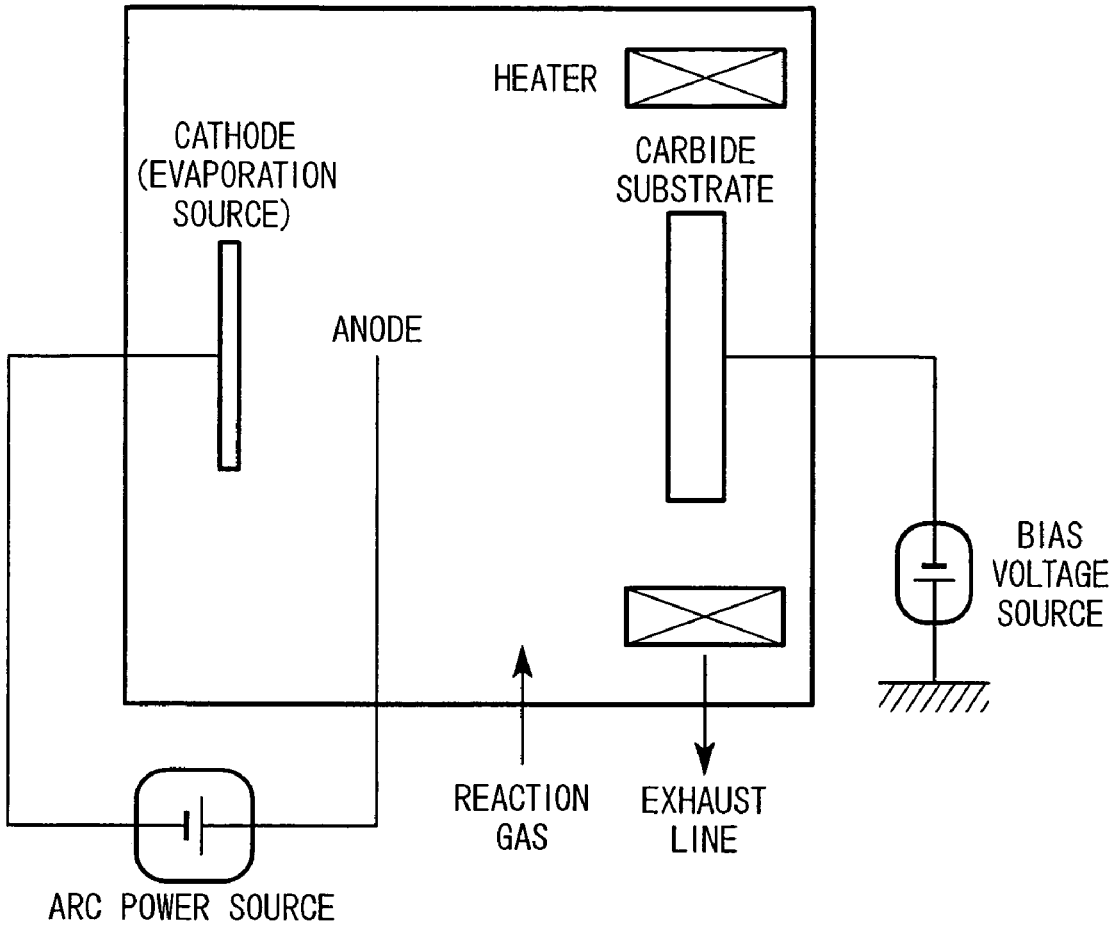
FIG. 3 is a schematic diagram showing an arc ion plating apparatus of the prior art.

For the purpose of comparison, the carbide substrates A-1 through A-10 and the carbide substrates B-1 through B-6 were subjected to ultrasonic cleaning in acetone. After drying, the carbide substrates were set in an arc ion plating apparatus as shown in FIG. 3, and the Ti—Al—Si alloy having the composition corresponding to the target composition shown in Tables 5 was disposed as a cathode (evaporation source). While evacuating the apparatus to maintain the inside at a level of vacuum not higher than 0.1 Pa, the inside of the apparatus was heated to 500° C. by a heater and a DC bias voltage of −1000 V was applied to the carbide substrate and arc discharge was generated by supplying a current of 100 A between the cathode made of the Ti—Al—Si alloy and the anode, thereby cleaning the surface of the carbide substrate by bombardment of the Ti—Al—Si alloy. Then nitrogen gas was introduced as a reaction gas into the apparatus to maintain a reaction atmosphere of 3 Pa, and the bias voltage applied to the carbide substrate was reduced to −100 V, and arc discharge was generated between the cathode made of the Ti—Al—Si alloy and the anode. Thus the surfaces of the carbide substrates A-1 through A-10 and B-1 through B-6 were coated with the (Ti, Al, Si)N layer of single phase structure having the target composition and target layer thickness shown in Tables 5 as a hard coating layer by vapor deposition, thereby making indexable inserts made of the surface-coated cemented carbide of the prior art (hereinafter referred to as the conventional surface-coated cemented carbide insert) Nos. 1 through 16 were made as the surface-coated cemented carbide tools of the prior art.

The surface-coated inserts made as described above were mounted at the distal end (the tip) of a cutting tool made of tool steel by screwing a clamp fixture. The inventive surface-coated cemented carbide inserts Nos. 1 through 16 and the conventional surface-coated cemented carbide inserts Nos. 1 through 16 were subjected to continuous high speed cutting operation test (normal cutting speed was 40 m/min.) in dry process of an alloy tool steel under the following conditions (conditions A).

Workpiece: Hardened round rod of JIS SKD61 (hardness HRC55)

Cutting speed: 80 m/min.

Infeed: 1.0 mm

Feedrate: 0.1 mm/rev.

Cutting time: 5 minutes

The surface-coated cemented carbide inserts made as described above were mounted at the distal end of cutting tools made of tool steel by screwing with a clamp fixture. The inventive surface-coated cemented carbide inserts Nos. 1 through 16 and the conventional surface-coated cemented carbide inserts Nos. 1 through 16 were subjected to intermittent high speed cutting operation test (normal cutting speed was 20 m/min.) in dry process of a bearing steel under the following conditions (conditions B).

Workpiece: Hardened round rod of JIS SUJ2 (hardness HRC56) with 4 grooves formed in longitudinal direction at equal spaces Cutting speed: 40 m/min.

Infeed: 0.8 mm

Feedrate: 0.1 mm/rev.

Cutting time: 5 minutes

The surface-coated cemented carbide inserts made as described above were mounted at the distal end of cutting tools made of tool steel by screwing a with clamp fixture. The inventive surface-coated cemented carbide inserts Nos. 1 through 16 and the conventional surface-coated cemented carbide inserts Nos. 1 through 16 were subjected to intermittent high speed cutting operation test (normal cutting speed was 20 m/min.) in dry process of an alloy tool steel under the following conditions (conditions C).

Workpiece: Hardened round rod of JIS SKD11 (hardness HRC58) with 4 grooves formed in longitudinal direction at equal spaces Cutting speed: 40 m/min.

Infeed: 0.6 mm

Feedrate: 0.12 mm/rev.

Cutting time: 5 minutes

Width of wear on the flank of the cutting tool edge (the cutting edge of the surface-coated cemented carbide insert) was measured in every run of the cutting test described above, with the results shown in Table 6.

TABLE 1

| Type | | Composition (% by mass) | | | | | | | | | |
|---|---|---|---|---|---|---|---|---|---|---|---|
| | | Co | TiC | ZrC | VC | TaC | NbC | $Cr_3C_2$ | TiN | TaN | WC |
| Carbide substrate | A-1 | 10.5 | 8 | — | — | 8 | 1.5 | — | — | — | Bal |
| | A-2 | 7 | — | — | | — | — | — | | — | Bal |
| | A-3 | 5.7 | — | — | — | 1.5 | 0.5 | — | — | — | Bal |
| | A-4 | 5.7 | — | — | — | — | — | 1 | — | — | Bal |
| | A-5 | 8.5 | — | 0.5 | — | — | — | 0.5 | — | — | Bal |
| | A-6 | 9 | — | — | — | 2.5 | 1 | — | — | — | Bal |
| | A-7 | 9 | 8.5 | — | — | 8 | 3 | — | — | — | Bal |
| | A-8 | 11 | 8 | — | — | 4.5 | — | — | 1.5 | — | Bal |
| | A-9 | 12.5 | 2 | — | — | — | — | — | 1 | 2 | Bal |
| | A-10 | 14 | — | — | 0.2 | — | — | 0.8 | — | — | Bal |

TABLE 2

| Type | | Composition (% by mass) | | | | | | | |
|---|---|---|---|---|---|---|---|---|---|
| | | Co | Ni | ZrC | TaC | NbC | $Mo_2C$ | WC | TiCN |
| Carbide substrate | B-1 | 13 | 5 | — | 10 | — | 10 | 16 | Bal |
| | B-2 | 8 | 7 | — | 5 | — | 7.5 | — | Bal |
| | B-3 | 5 | — | — | — | — | 6 | 10 | Bal |
| | B-4 | 10 | 5 | — | 11 | 2 | — | — | Bal |

TABLE 2-continued

| Type | | Composition (% by mass) | | | | | | | |
|---|---|---|---|---|---|---|---|---|---|
| | | Co | Ni | ZrC | TaC | NbC | $Mo_2C$ | WC | TiCN |
| | B-5 | 9 | 4 | 1 | 8 | — | 10 | 10 | Bal |
| | B-6 | 12 | 5.5 | — | 10 | — | 9.5 | 14.5 | Bal |

TABLE 3

| Type | | Symbol of carbide substrate | Hard coating layer | | | | | | | | | | | | | | | | |
|---|---|---|---|---|---|---|---|---|---|---|---|---|---|---|---|---|---|---|---|
| | | | Bottom layer | | | | | Top layer, thin layer A | | | | | Top layer, thin layer B | | | | | Total | |
| | | | Target composition (atomic ratio) | | | | Target thickness | Target composition (atomic ratio) | | | | Target thickness of one layer | Target composition (atomic ratio) | | | | Target thickness of one layer | target thickness of top layer | |
| | | | Ti | Al | Si | N | (μm) | Ti | Al | Si | N | (nm) | Ti | Al | Si | N | (nm) | (μm) | |
| Inventive surface-coated cemented carbide insert | 1 | A-1 | 0.45 | 0.52 | 0.03 | 1.00 | 3.5 | 0.68 | 0.03 | 0.29 | 1.00 | 10 | 0.45 | 0.40 | 0.15 | 1.00 | 10 | 1 | |
| | 2 | A-2 | 0.36 | 0.56 | 0.08 | 1.00 | 2 | 0.63 | 0.02 | 0.35 | 1.00 | 5 | 0.53 | 0.35 | 0.12 | 1.00 | 10 | 0.5 | |
| | 3 | A-3 | 0.37 | 0.58 | 0.05 | 1.00 | 5.5 | 0.67 | 0.06 | 0.27 | 1.00 | 20 | 0.60 | 0.30 | 0.10 | 1.00 | 20 | 1.5 | |
| | 4 | A-4 | 0.39 | 0.60 | 0.01 | 1.00 | 4 | 0.74 | 0.01 | 0.25 | 1.00 | 10 | 0.55 | 0.35 | 0.10 | 1.00 | 10 | 1 | |
| | 5 | A-5 | 0.42 | 0.56 | 0.02 | 1.00 | 6 | 0.68 | 0.05 | 0.27 | 1.00 | 15 | 0.52 | 0.45 | 0.13 | 1.00 | 5 | 0.5 | |
| | 6 | A-6 | 0.43 | 0.50 | 0.07 | 1.00 | 3 | 0.65 | 0.04 | 0.31 | 1.00 | 20 | 0.56 | 0.30 | 0.14 | 1.00 | 20 | 1.5 | |
| | 7 | A-7 | 0.40 | 0.54 | 0.06 | 1.00 | 2.5 | 0.69 | 0.02 | 0.29 | 1.00 | 5 | 0.40 | 0.45 | 0.15 | 1.00 | 5 | 0.5 | |
| | 8 | A-8 | 0.44 | 0.52 | 0.04 | 1.00 | 4.5 | 0.62 | 0.05 | 0.33 | 1.00 | 10 | 0.59 | 0.40 | 0.11 | 1.00 | 15 | 1 | |
| | 9 | A-9 | 0.33 | 0.58 | 0.09 | 1.00 | 3.5 | 0.65 | 0.04 | 0.31 | 1.00 | 15 | 0.53 | 0.35 | 0.12 | 1.00 | 10 | 1.5 | |
| | 10 | A-10 | 0.43 | 0.54 | 0.03 | 1.00 | 6 | 0.61 | 0.06 | 0.33 | 1.00 | 5 | 0.58 | 0.40 | 0.12 | 1.00 | 15 | 1 | |

TABLE 4

| Type | | Symbol of carbide substrate | Hard coating layer | | | | | | | | | | | | | | | | |
|---|---|---|---|---|---|---|---|---|---|---|---|---|---|---|---|---|---|---|---|
| | | | Bottom layer | | | | | Top layer, thin layer A | | | | | Top layer, thin layer B | | | | | Total | |
| | | | Target composition (atomic ratio) | | | | Target thickness | Target composition (atomic ratio) | | | | Target thickness of one layer | Target composition (atomic ratio) | | | | Target thickness of one layer | target thickness of top layer | |
| | | | Ti | Al | Si | N | (μm) | Ti | Al | Si | N | (nm) | Ti | Al | Si | N | (nm) | (μm) | |
| Inventive surface-coated cemented | 11 | B-1 | 0.33 | 0.54 | 0.08 | 1.00 | 5.5 | 0.51 | 0.06 | 0.35 | 1.00 | 10 | 0.52 | 0.35 | 0.13 | 1.00 | 20 | 1 | |
| | 12 | B-2 | 0.45 | 0.50 | 0.05 | 1.00 | 4 | 0.74 | 0.01 | 0.25 | 1.00 | 20 | 0.46 | 0.40 | 0.14 | 1.00 | 5 | 0.5 | |
| | 13 | B-3 | 0.39 | 0.60 | 0.01 | 1.00 | 6 | 0.68 | 0.05 | 0.27 | 1.00 | 5 | 0.40 | 0.45 | 0.15 | 1.00 | 10 | 1 | |
| | 14 | B-4 | 0.42 | 0.56 | 0.02 | 1.00 | 2 | 0.65 | 0.04 | 0.31 | 1.00 | 20 | 0.59 | 0.30 | 0.11 | 1.00 | 20 | 1.5 | |

TABLE 4-continued

| | | | Hard coating layer | | | | | | | | | | | | | | | |
|---|---|---|---|---|---|---|---|---|---|---|---|---|---|---|---|---|---|---|
| | | | | | | | | Top layer, thin layer A | | | | | Top layer, thin layer B | | | | | Total |
| | | | Bottom layer | | | | | | | | | | | | | | | |
| | | Symbol of carbide | Target composition (atomic ratio) | | | | Target thick-ness | Target composition (atomic ratio) | | | | Target thick-ness of one layer | Target composition (atomic ratio) | | | | Target thick-ness of one layer | target thick-ness of top layer |
| Type | | substrate | Ti | Al | Si | N | (μm) | Ti | Al | Si | N | (nm) | Ti | Al | Si | N | (nm) | (μm) |
| carbide | 15 | B-5 | 0.41 | 0.52 | 0.07 | 1.00 | 4.5 | 0.69 | 0.02 | 0.29 | 1.00 | 10 | 0.45 | 0.40 | 0.15 | 1.00 | 5 | 1 |
| insert | 16 | B-6 | 0.36 | 0.58 | 0.06 | 1.00 | 3.5 | 0.62 | 0.05 | 0.33 | 1.00 | 15 | 0.53 | 0.35 | 0.12 | 1.00 | 15 | 0.5 |

TABLE 5

| | | | Hard coating layer | | | | |
|---|---|---|---|---|---|---|---|
| | | Symbol of carbide | Target composition (atomic ratio) | | | | Target thickness |
| Type | | substrate | Ti | Al | Si | N | (μm) |
| Conventional | 1 | A-1 | 0.45 | 0.52 | 0.03 | 1.00 | 4.5 |
| surface- | 2 | A-2 | 0.36 | 0.56 | 0.08 | 1.00 | 2.5 |
| coated | 3 | A-3 | 0.37 | 0.58 | 0.05 | 1.00 | 7 |
| cemented | 4 | A-4 | 0.39 | 0.60 | 0.01 | 1.00 | 5 |
| carbide | 5 | A-5 | 0.42 | 0.56 | 0:02 | 1.00 | 6.5 |
| insert | 6 | A-6 | 0.43 | 0.50 | 0.07 | 1.00 | 4.5 |
| | 7 | A-7 | 0.40 | 0.54 | 0.06 | 1.00 | 3 |
| | 8 | A-8 | 0.44 | 0.52 | 0.04 | 1.00 | 5.5 |
| | 9 | A-9 | 0.33 | 0.58 | 0.09 | 1.00 | 5 |
| | 10 | A-10 | 0.43 | 0.54 | 0.03 | 1.00 | 7 |
| | 11 | B-1 | 0.33 | 0.54 | 0.08 | 1.00 | 6.5 |
| | 12 | B-2 | 0.45 | 0.50 | 0.05 | 1.00 | 4.5 |
| | 13 | B-3 | 0.39 | 0.60 | 0.01 | 1.00 | 7 |
| | 14 | B-4 | 0.42 | 0.56 | 0.02 | 1.00 | 3.5 |
| | 15 | B-5 | 0.41 | 0.52 | 0.07 | 1.00 | 5.5 |
| | 16 | B-6 | 0.36 | 0.58 | 0.06 | 1.00 | 4. |

EXAMPLE 2

A coarse WC powder having a mean particle size of 5.5 μm, a fine WC powder having a mean particle size of 0.8 μm, a TaC powder having a mean particle size of 1.3 μm, a NbC powder having a mean particle size of 1.2 μm, a ZrC powder having a mean particle size of 1.2 μm, a $Cr_3C_2$ powder having a mean particle size of 2.3 μm, a VC powder having a mean particle size of 1.5 μm, a (Ti, W)C powder (TiC/WC=50/50 in mass proportion) having a mean particle size of 1.0 μm and a Co powder having a mean particle size of 1.8 μm were prepared as material powder and were mixed in proportions shown in Table 7. Wax was added to this mixture and mixed in acetone in a ball mill for 24 hours. After drying under a reduced pressure, the material was pressed into green compacts of predetermined shape with a pressure of 100 MPa. The green compacts were heated at a rate of 7° C. per minute to a predetermined temperature in a range from 1370 to 1470° C. in vacuum of 6 Pa and were sintered while being held at this temperature for 1 hour, before being cooled down in the furnace, thereby to make three kinds of sintered round rod to

TABLE 6

| | | Width of wear on the flank (nm) | | | | | Width of wear on the flank (nm) | | |
|---|---|---|---|---|---|---|---|---|---|
| Type | | Cutting conditions A | Cutting conditions B | Cutting conditions C | Type | | Cutting conditions A | Cutting conditions B | Cutting conditions C |
| Inventive | 1 | 0.15 | 0.14 | 0.18 | Conventional | 1 | 0.38 | 0.41 | 0.42 |
| surface- | 2 | 0.16 | 0.14 | 0.16 | surface- | 2 | 0.39 | 0.40 | 0.44 |
| coated | 3 | 0.16 | 0.15 | 0.16 | coated | 3 | 0.43 | 0.44 | 0.43 |
| cemented | 4 | 0.13 | 0.12 | 0.17 | cemented | 4 | 0.41 | 0.41 | 0.43 |
| carbide | 5 | 0.14 | 0.14 | 0.18 | carbide | 5 | 0.40 | 0.39 | 0.41 |
| insert | 6 | 0.16 | 0.14 | 0.15 | insert | 6 | 0.39 | 0.40 | 0.42 |
| | 7 | 0.15 | 0.15 | 0.17 | | 7 | 0.42 | 0.41 | 0.42 |
| | 8 | 0.15 | 0.15 | 0.16 | | 8 | 0.39 | 0.42 | 0.43 |
| | 9 | 0.13 | 0.14 | 0.17 | | 9 | 0.41 | 0.42 | 0.44 |
| | 10 | 0.16 | 0.15 | 0.15 | | 10 | 0.40 | 0.41 | 0.41 |
| | 11 | 0.12 | 0.11 | 0.14 | | 11 | 0.38 | 0.39 | 0.40 |
| | 12 | 0.12 | 0.12 | 0.13 | | 12 | 0.35 | 0.37 | 0.39 |
| | 13 | 0.13 | 0.11 | 0.14 | | 13 | 0.38 | 0.39 | 0.40 |
| | 14 | 0.12 | 0.12 | 0.13 | | 14 | 0.37 | 0.40 | 0.37 |
| | 15 | 0.14 | 0.12 | 0.15 | | 15 | 0.37 | 0.38 | 0.41 |
| | 16 | 0.13 | 0.13 | 0.14 | | 16 | 0.36 | 0.39 | 0.39 |

be used to form three kinds of the carbide substrate having diameters of 8 mm, 13 mm and 26 mm. The three kinds of sintered round rod were ground to make carbide substrates (end mills) C-1 through C-8 made of WC-based cemented carbide having 4-flute square configuration with helix angle of 30 degrees, measuring 6 mm×13 mm, 10 mm×22 mm and 20 mm×45 mm in diameter and length of the cutting edge as shown in Table 7.

The carbide substrates (end mills) C-1 through C-8 were cleaned on the surface with ultrasound in acetone. After drying, the carbide substrates were set in an arc ion plating apparatus as shown in FIG. 1 and FIG. 2, and the bottom layer including (Ti, Al, Si)N layer of single phase structure having the target composition and target layer thickness shown in Table 8 and the top layer, including the thin layer A and the thin layer B having the target composition and target thickness of single layer shown in Table 8 stacked alternately one on another, were formed by vapor deposition to the total thickness shown in table 8. Thus end mill made of surface-coated cemented carbide of the present invention (hereinafter referred to as the inventive surface-coated cemented carbide end mill) Nos. 1 through 8 were made as the surface-coated cemented carbide cutting tool of the present invention.

For the purpose of comparison, the carbide substrates (end mills) C-1 through C-8 were cleaned on the surface with ultrasound in acetone. After drying, the carbide substrates were set in an arc ion plating apparatus as shown in FIG. 3, and the hard coating layer constituted from (Ti, Al, Si)N layer of single phase structure having the target composition and target thickness shown in Table 9 was formed by vapor deposition under the same conditions as in Example 1. Thus end mills made of surface-coated cemented carbide of the prior art (hereinafter referred to as the conventional surface-coated cemented carbide end mill) Nos. 1 through 8 were made as the surface-coated cemented carbide cutting tool of the prior art.

Among the inventive surface-coated cemented carbide end mills Nos. 1 through 8 and the conventional surface-coated cemented carbide end mills Nos. 1 through 8, the inventive surface-coated cemented carbide end mills Nos. 1 through 3 and the conventional surface-coated cemented carbide end mills Nos. 1 through 3 were subjected to high speed slot cutting test of an alloy tool steel (normal cutting speed was 20 m/min.) under the following conditions.

Workpiece: Plate of hardened JIS SKD11 (hardness HRC58) measuring 100 mm×250 mm with thickness of 50 mm
Cutting speed: 40 m/min.
Depth of slot (Infeed): 0.2 mm
Table feedrate: 100 mm/min.

The inventive surface-coated cemented carbide end mills Nos. 4 through 6 and the conventional surface-coated cemented carbide end mills Nos. 4 through 6 were subjected to high speed slot cutting test of bearing steel in dry process (normal cutting speed was 20 m/min.) under the following conditions.

Workpiece: Plate of hardened JIS SUJ2 (hardness HRC56) measuring 100 mm×250 mm with thickness of 50 mm
Cutting speed: 35 m/min.
Slot depth (infeed): 0.3 mm
Table feedrate: 100 mm/min.

The inventive surface-coated cemented carbide end mills Nos. 7, 8 and the conventional surface-coated carbide surface-coated cemented carbide end mills Nos. 7, 8 were subjected to high speed slot cutting test of an alloy tool steel in dry process (normal cutting speed was 40 m/min.) under the following conditions.

Workpiece: Plate of hardened JIS SKD61 (hardness HRC55) measuring 100 mm×250 mm with thickness of 50 mm
Cutting speed: 80 m/min.
Slot depth (infeed): 0.8 mm
Table feedrate: 40 mm/min.

The length of slot that was cut before the width of wear on the flank of the peripheral cutting edge reached 0.1 mm, that indicates the end of service life, was measured in every run of the slot cutting test. Results of measurements are shown in Tables 8 and 9.

TABLE 7

| Type | | Composition (% by mass) | | | | | | | | Diameter × length of cutting edge |
|---|---|---|---|---|---|---|---|---|---|---|
| | | Co | (Ti, W) C | TaC | NbC | ZrC | $Cr_3C_2$ | VC | WC | (mm) |
| Carbide | C-1 | 5 | 5 | — | — | — | — | — | Coarse particles: bal | 6 × 13 |
| substrate | C-2 | 6 | — | 1 | 0.5 | — | — | — | Fine particles: bal | 6 × 13 |
| (End mill) | C-3 | 6 | — | 1 | — | 1 | 0.5 | 0.5 | Fine particles: bal | 6 × 13 |
| | C-4 | 8 | — | — | — | — | 0.5 | 0.5 | Fine particles: bal | 10 × 22 |
| | C-5 | 9 | 25 | 10 | 1 | — | — | — | Coarse particles: bal | 10 × 22 |
| | C-6 | 10 | — | — | — | — | 1 | — | Fine particles: bal | 10 × 22 |
| | C-7 | 12 | 17 | 9 | 1 | — | — | — | Coarse particles: bal | 20 × 45 |
| | C-8 | 16 | — | 10 | 5 | 10 | — | — | Coarse particles: bal | 20 × 45 |

TABLE 8

| | | | Hard coating layer | | | | | | | | | | | | | | | | | |
|---|---|---|---|---|---|---|---|---|---|---|---|---|---|---|---|---|---|---|---|---|
| | | | Bottom layer | | | | | Top layer, thin layer A | | | | | Top layer, thin layer B | | | | | | | |
| | | Symbol of carbide sub- | Target composition (atomic ratio) | | | | Target thickness | Target composition (atomic ratio) | | | | Target thickness of one layer | Target composition (atomic ratio) | | | | Target thickness of one layer | Total target thickness of top layer | Slot length that was cut |
| Type | | strate | Ti | Al | Si | N | (μm) | Ti | Al | Si | N | (nm) | Ti | Al | Si | N | (nm) | (μm) | (m) |
| Inventive surface-coated cemented carbide end mill | 1 | C-1 | 0.42 | 0.54 | 0.04 | 1.00 | 4 | 0.68 | 0.03 | 0.29 | 1.00 | 5 | 0.52 | 0.35 | 0.13 | 1.00 | 10 | 0.5 | 60 |
| | 2 | C-2 | 0.33 | 0.58 | 0.09 | 1.00 | 2.5 | 0.63 | 0.02 | 0.35 | 1.00 | 10 | 0.46 | 0.40 | 0.14 | 1.00 | 20 | 1.5 | 55 |
| | 3 | C-3 | 0.45 | 0.52 | 0.03 | 1.00 | 2 | 0.63 | 0.06 | 0.31 | 1.00 | 15 | 0.40 | 0.45 | 0.15 | 1.00 | 15 | 1 | 55 |
| | 4 | C-4 | 0.32 | 0.60 | 0.08 | 1.00 | 3.5 | 0.74 | 0.01 | 0.25 | 1.00 | 20 | 0.49 | 0.40 | 0.11 | 1.00 | 5 | 1.5 | 65 |
| | 5 | C-5 | 0.39 | 0.56 | 0.05 | 1.00 | 3 | 0.68 | 0.05 | 0.27 | 1.00 | 15 | 0.43 | 0.45 | 0.12 | 1.00 | 10 | 1 | 65 |
| | 6 | C-6 | 0.43 | 0.56 | 0.01 | 1.00 | 4.5 | 0.65 | 0.04 | 0.31 | 1.00 | 10 | 0.56 | 0.30 | 0.14 | 1.00 | 20 | 0.5 | 60 |
| | 7 | C-7 | 0.44 | 0.54 | 0.02 | 1.00 | 3.5 | 0.69 | 0.02 | 0.29 | 1.00 | 10 | 0.45 | 0.40 | 0.15 | 1.00 | 10 | 1.5 | 55 |
| | 8 | C-8 | 0.43 | 0.50 | 0.07 | 1.00 | 2.5 | 0.62 | 0.05 | 0.33 | 1.00 | 5 | 0.55 | 0.35 | 0.10 | 1.00 | 15 | 0.5 | 60 |

TABLE 9

| | | | Hard coating layer | | | | | Slot |
|---|---|---|---|---|---|---|---|---|
| | | Symbol of carbide | Target composition (atomic ratio) | | | | Target thickness | length that was |
| Type | | substrate | Ti | Al | Si | N | (μm) | cut (m) |
| Conventional surface-coated cemented carbide end mill | 1 | C-1 | 0.42 | 0.54 | 0.04 | 1.00 | 4.5 | 15 |
| | 2 | C-2 | 0.33 | 0.58 | 0.09 | 1.00 | 4 | 20 |
| | 3 | C-3 | 0.45 | 0.52 | 0.03 | 1.00 | 3 | 15 |
| | 4 | C-4 | 0.32 | 0.60 | 0.08 | 1.00 | 5 | 20 |
| | 5 | C-5 | 0.39 | 0.56 | 0.05 | 1.00 | 4 | 20 |
| | 6 | C-6 | 0.43 | 0.56 | 0.01 | 1.00 | 5 | 25 |
| | 7 | C-7 | 0.44 | 0.54 | 0.02 | 1.00 | 5 | 25 |
| | 8 | C-8 | 0.43 | 0.50 | 0.07 | 1.00 | 3 | 25 |

EXAMPLE 3

The three kinds of sintered round rods, having the diameter of 8 mm (used to form the carbide substrates C-1 through C-3), diameter of 13 mm (used to form the carbide substrates C-4 through C-6) and diameter of 26 mm (used to form the carbide substrates C-7 and C-8) made in Example 2 were ground to make carbide substrates (drills) D-1 through D-8 made of WC-based cemented carbide having 2-flute configuration with helix angle of 30 degrees, measuring 4 mm×13 mm (carbide substrates D-1 through D-3), 8 mm×22 mm (carbide substrates D-4 through D-6) and 16 mm×45 mm (carbide substrates D-7 and D-8) in diameter and length of the slot forming section.

The carbide substrates (drills) D-1 through D-8 were subjected to honing of the cutting edge and were cleaned on the surface with ultrasound in acetone. After drying, the carbide substrates were set in an arc ion plating apparatus as shown in FIG. 1 and FIG. 2, and the bottom layer having (Ti, Al, Si)N layer of single phase structure having the target composition and target thickness shown in Table 10 and the top layer including the thin layer A and the thin layer B having the target composition and target thickness shown in Table 10 being stacked alternately one on another were formed along the direction of the layer thickness by vapor deposition to the total thickness shown in table 10 under the same conditions as those of Example 1. Thus drills made of surface-coated cemented carbide of the present invention (hereinafter referred to as the inventive surface-coated cemented carbide drills) Nos. 1 through 8 were made as the surface-coated cemented carbide cutting tools of the present invention.

For the purpose of comparison, the carbide substrates (drills) D-1 through D-8 were subjected to honing of the surface of the cutting edge and were cleaned on the surface with ultrasound in acetone. After drying, the carbide substrates were set in an arc ion plating apparatus as shown in FIG. 3, and the hard coating layer constituted from (Ti, Al, Si)N layer of single phase structure having the target composition and target thickness shown in Table 11 was formed by vapor deposition under the same conditions as those of Example 1. Thus drills made of surface-coated cemented carbide of the prior art (hereinafter referred to as the conventional surface-coated cemented carbide drills) Nos. 1 through 8 were made as the surface-coated cemented carbide cutting tool of the prior art.

Among the inventive surface-coated cemented carbide drills Nos. 1 through 8 and the conventional surface-coated cemented carbide drills Nos. 1 through 8, the inventive surface-coated cemented carbide drill Nos. 1 through 3 and the conventional surface-coated cemented carbide drills Nos. 1 through 3 were subjected to high speed drilling test of an alloy tool steel in wet process (normal cutting speed was 20 m/min.) under the following conditions.

Workpiece: Plate of hardened JIS SKD11 (hardness HRC58) measuring 100 mm×250 mm with thickness of 50 mm Cutting speed: 35 m/min.

Feedrate: 0.1 mm/rev.

Depth of hole: 8 mm

The number of holes that were drilled before the width of wear on the flank of the end cutting edge reached 0.3 mm was measured in every run of the high speed drilling test in wet process (water-soluble cutting fluid used). Results of measurements are shown in Tables 10 and 11.

TABLE 10

| | | | Hard coating layer | | | | | | | | | | | | | | | | |
|---|---|---|---|---|---|---|---|---|---|---|---|---|---|---|---|---|---|---|---|
| | | | Bottom layer | | | | | Top layer, thin layer A | | | | | Top layer, thin layer B | | | | | | |
| | | Symbol of carbide sub- | Target composition (atomic ratio) | | | | Target thickness | Target composition (atomic ratio) | | | | Target thickness of one layer | Target composition (atomic ratio) | | | | Target thickness of one layer | Total target thickness of top layer | Number of holes that were |
| Type | | strate | Ti | Al | Si | N | (μm) | Ti | Al | Si | N | (nm) | Ti | Al | Si | N | (nm) | (μm) | drilled |
| Inventive surface-coated cemented carbide drill | 1 | D-1 | 0.42 | 0.52 | 0.06 | 1.00 | 4.5 | 0.68 | 0.05 | 0.27 | 1.00 | 20 | 0.60 | 0.30 | 0.10 | 1.00 | 10 | 1 | 550 |
| | 2 | D-2 | 0.40 | 0.56 | 0.04 | 1.00 | 5 | 0.63 | 0.04 | 0.33 | 1.00 | 10 | 0.53 | 0.35 | 0.12 | 1.00 | 10 | 0.5 | 500 |
| | 3 | D-3 | 0.33 | 0.58 | 0.09 | 1.00 | 2.5 | 0.69 | 0.02 | 0.29 | 1.00 | 5 | 0.45 | 0.40 | 0.15 | 1.00 | 5 | 1 | 500 |
| | 4 | D-4 | 0.47 | 0.50 | 0.03 | 1.00 | 2 | 0.70 | 0.05 | 0.25 | 1.00 | 5 | 0.42 | 0.45 | 0.13 | 1.00 | 20 | 1.5 | 250 |
| | 5 | D-5 | 0.32 | 0.60 | 0.08 | 1.00 | 3 | 0.61 | 0.04 | 0.35 | 1.00 | 20 | 0.45 | 0.40 | 0.15 | 1.00 | 15 | 1 | 250 |
| | 6 | D-6 | 0.41 | 0.54 | 0.05 | 1.00 | 3.5 | 0.63 | 0.06 | 0.31 | 1.00 | 15 | 0.54 | 0.35 | 0.11 | 1.00 | 5 | 0.5 | 250 |
| | 7 | D-7 | 0.39 | 0.60 | 0.01 | 1.00 | 4 | 0.74 | 0.01 | 0.25 | 1.00 | 10 | 0.43 | 0.45 | 0.12 | 1.00 | 10 | 0.5 | 130 |
| | 8 | D-8 | 0.46 | 0.52 | 0.02 | 1.00 | 3.5 | 0.64 | 0.03 | 0.33 | 1.00 | 15 | 0.56 | 0.30 | 0.14 | 1.00 | 20 | 1 | 120 |

TABLE 11

| | | | Hard coating layer | | | | | |
|---|---|---|---|---|---|---|---|---|
| | | Symbol of carbide | Target composition (atomic ratio) | | | | Target thickness | Number of holes that |
| Type | | substrate | Ti | Al | Si | N | (μm) | were drilled |
| Conventional surface-coated cemented carbide drill | 1 | D-1 | 0.42 | 0.52 | 0.06 | 1.00 | 5.5 | 250 |
| | 2 | D-2 | 0.40 | 0.56 | 0.04 | 1.00 | 5.5 | 220 |
| | 3 | D-3 | 0.33 | 0.58 | 0.09 | 1.00 | 3.5 | 250 |
| | 4 | D-4 | 0.47 | 0.50 | 0.03 | 1.00 | 3.5 | 120 |
| | 5 | D-5 | 0.32 | 0.60 | 0.08 | 1.00 | 4 | 100 |
| | 6 | D-6 | 0.41 | 0.54 | 0.05 | 1.00 | 4 | 120 |
| | 7 | D-7 | 0.39 | 0.60 | 0.01 | 1.00 | 4.5 | 60 |
| | 8 | D-8 | 0.46 | 0.52 | 0.02 | 1.00 | 4.5 | 70 |

The inventive surface-coated cemented carbide drills Nos. 4 through 6 and the conventional surface-coated cemented carbide drills Nos. 4 through 6 were subjected to high speed drilling test of bearing steel in wet process (normal cutting speed was 25 m/min.) under the following conditions.

Workpiece: Plate of hardened JIS SUJ2 (hardness HRC56) measuring 100 mm×250 mm with thickness of 50 mm Cutting speed: 50 m/min.

Feedrate: 0.12 mm/rev.

Depth of hole: 16 mm

The inventive surface-coated cemented carbide drills Nos. 7, 8 and the conventional surface-coated cemented carbide drills Nos. 7, 8 were subjected to high speed drilling test of an alloy tool steel in wet process (normal cutting speed was 30 m/min.) under the following conditions.

Workpiece: Plate of hardened JIS SKD61 (hardness HRC55) measuring 100 mm×250 mm with thickness of 50 mm Cutting speed: 65 m/min.

Feedrate: 0.18 mm/rev.

Depth of hole: 32 mm

Compositions of the thin layer A and the thin layer B of the top layer and the bottom layer that constitute the hard coating layer made of (Ti, Al, Si)N of the inventive surface-coated cemented carbide inserts Nos. 1 through 16, the inventive surface-coated cemented carbide end mills Nos. 1 through 8 the inventive surface-coated cemented carbide drills Nos. 1 through 8, and compositions of the hard coating layer made of (Ti, Al, Si)N of the conventional surface-coated cemented carbide inserts Nos. 1 through 16, the conventional surface-coated cemented carbide end mills Nos. 1 through 8 and the conventional surface-coated cemented carbide drills Nos. 1 through 8 were analyzed by energy dispersion type X-ray spectroscopy using a transmission electron microscope, and all samples showed substantially the same compositions as the target compositions.

Mean layer thickness of the constituent layers of the hard coating layer was measured by observing the cross section with a transmission electron microscope. All samples showed substantially the same mean thickness as the target thickness (mean of measurements at 5 points).

The results shown in Tables 3 through 11 show that, all the surface-coated cemented carbide cutting tools had the hard coating layer of constitution including the bottom layer formed from (Ti, Al, Si)N in single phase structure of different compositions and the top layer having the thin layer A and the thin layer B each having the thickness in a range from 5 to 20 nm stacked alternately one on another, that the bottom layer exhibited excellent hardness at high temperatures and the top layer exhibited excellent heat resistance, so that the hard coating layer combined these excellent characteristics, and therefore excellent wear resistance can be maintained over an extended period of time without chipping of the hard coating layer even in high speed cutting operation of a high hardness steel that generates much heat during cutting operation. The conventional surface-coated cemented carbide inserts having the hard coating layer consisting (Ti, Al, Si)N layer of the single phase structure, in contrast, underwent rapid progress of wear due to insufficient heat resistance and it is apparent that service life will end in a relatively short period of time.

As described above, the surface-coated cemented carbide cutting tool of the present invention exhibits excellent wear resistance even in high speed cutting operation of a high hardness steel that generates much heat during cutting operation, not to mentions machining of various steels and cast iron under ordinary cutting conditions, and maintains excellent cutting performance over an extended period of time. Thus the surface-coated cemented carbide cutting tool of the present invention allows for dramatic advancements in the performance of metal cutting machines, and for labor saving, energy saving and cost reduction in metal cutting operations.

While preferred embodiments of the invention have been described and illustrated above, it should be understood that these are exemplary of the invention and are not to be considered limiting. Additions, omissions, substitutions and other modifications can be made without departing from the spirit or scope of the present invention. Accordingly, the invention is not considered as being limited by the foregoing description, and is only limited by the scope of the appended claims.

What is claimed is:

1. A cutting tool made of surface-coated cemented carbide having a hard coating layer that exhibits excellent wear resistance in high speed cuffing operation of high hardness steel, comprising:

a carbide substrate made of tungsten-carbide cemented carbide or titanium-carbonitride cermet and the hard coating layer formed on the surface of the carbide substrate by vapor deposition, wherein (a) the hard coating layer includes a top layer and a bottom layer both formed from composite nitride of Ti, Al and Si, the top layer having the thickness in a range from 0.5 to 1.5 μm and the bottom layer having the thickness in a range from 2 to 6 μm;

(b) the top layer includes a structure having the thin layer A and the thin layer B stacked alternately each having the thickness of 5 to 20 nm, with the thin layer A comprising composite nitride of Ti, Al and Si having the composition of $[Ti_{1-(A+B)}Al_ASi_B]N$ (A is in a range from 0.01 to 0.06 and B is in a range from 0.25 to 0.35 in an atomic ratio) and the thin layer B comprising composite nitride of Ti, Al and Si having the composition of $[Ti_{1-(C+D)}Al_CSi_D]N$ (C is in a range from 0.30 to 0.45 and D is in a range from 0.10 to 0.15 in an atomic ratio); and (c) the bottom layer comprising composite nitride of Ti, Al and Si of single phase structure having the composition of $[Ti_{1-(E+F)}Al_ESi_F]N$ (E is in a range from 0.50 to 0.60 and F is in a range from 0.01 to 0.09 in an atomic ratio).

* * * * *